US010093395B2

(12) United States Patent
Felderhoff

(10) Patent No.: US 10,093,395 B2
(45) Date of Patent: Oct. 9, 2018

(54) VESSEL HULL FOR USE AS A HULL OF A FLOATING HYDROCARBON STORAGE AND/OR PROCESSING PLANT, METHOD FOR PRODUCING SUCH A VESSEL HULL, VESSEL COMPRISING SUCH A VESSEL HULL, AS WELL METHOD FOR PRODUCING SUCH A VESSEL HAVING SUCH A VESSEL HULL

(71) Applicant: Single Buoy Moorings Inc., Marly (CH)

(72) Inventor: Jean-Michel Felderhoff, Monaco (MC)

(73) Assignee: Single Buoy Moorings Inc., Marly (CH)

( * ) Notice: Subject to any disclaimer, the term of this patent is extended or adjusted under 35 U.S.C. 154(b) by 33 days.

(21) Appl. No.: 15/521,906

(22) PCT Filed: Aug. 11, 2015

(86) PCT No.: PCT/EP2015/068429
§ 371 (c)(1),
(2) Date: Apr. 26, 2017

(87) PCT Pub. No.: WO2016/066295
PCT Pub. Date: May 6, 2016

(65) Prior Publication Data

US 2017/0327190 A1 Nov. 16, 2017

(30) Foreign Application Priority Data

Oct. 28, 2014 (EP) ..... 14190676

(51) Int. Cl.
*B63B 35/44* (2006.01)
*B63B 21/50* (2006.01)
(Continued)

(52) U.S. Cl.
CPC ..... *B63B 21/507* (2013.01); *B63B 3/70* (2013.01); *B63B 9/06* (2013.01); *B63B 35/44* (2013.01); *B63B 2035/448* (2013.01)

(58) Field of Classification Search
CPC ..... B63B 21/507; B63B 3/70; B63B 35/44; B63B 2035/448
(Continued)

(56) References Cited

U.S. PATENT DOCUMENTS 5,664,518 A * 9/1997 Lewit ..... B29C 44/1209 114/357
6,126,501 A * 10/2000 Hooper ..... B63B 21/507 114/230.12
(Continued)

*Primary Examiner* — S. Joseph Morano
*Assistant Examiner* — Jovon E Hayes
(74) *Attorney, Agent, or Firm* — NLO N.V.; Catherine A. Shultz; Lindsey A. Auerbach

(57) ABSTRACT

The invention relates to a method for producing a vessel hull (1) for use as a hull of an FPSO or FSO, comprising producing a vessel hull with a stern portion (2), a bow portion (3) and a central portion (4), arranging a deck (6) on the hull, for supporting processing modules, arranging hydrocarbon storage tanks inside the hull, providing the hull with an anchoring connection arrangement (7), characterized by arranging process module reinforcements (8) in the deck for supporting the hydrocarbon process modules, providing both longitudinal hull sides with mooring line connection reinforcements (9) at or near the bow portion, arranging riser connection reinforcements (10, 14) on one or more longitudinal hull sides, in between the mooring line connection reinforcements in longitudinal direction, for a riser balcony (28, 29), and providing the bow portion with turret reinforcements (11, 12).

19 Claims, 4 Drawing Sheets

(51) Int. Cl.
*B63B 3/70* (2006.01)
*B63B 9/06* (2006.01)

(58) Field of Classification Search
USPC ..... 441/3, 6
See application file for complete search history.

(56) References Cited

U.S. PATENT DOCUMENTS

| | | | | |
|---|---|---|---|---|
| 6,453,838 | B1 * | 9/2002 | Mowell | B63B 35/4413 114/144 B |
| 2003/0205188 | A1 * | 11/2003 | McCollum | B63B 9/00 114/230.12 |
| 2009/0078185 | A1 * | 3/2009 | Poldervaart | B63B 21/50 114/256 |
| 2009/0126617 | A1 * | 5/2009 | Millheim | B63B 21/508 114/264 |
| 2011/0263169 | A1 * | 10/2011 | Meling | B63B 21/50 441/4 |
| 2017/0327190 | A1 * | 11/2017 | Felderhoff | B63B 21/507 |

* cited by examiner

VESSEL HULL FOR USE AS A HULL OF A FLOATING HYDROCARBON STORAGE AND/OR PROCESSING PLANT, METHOD FOR PRODUCING SUCH A VESSEL HULL, VESSEL COMPRISING SUCH A VESSEL HULL, AS WELL METHOD FOR PRODUCING SUCH A VESSEL HAVING SUCH A VESSEL HULL

FIELD OF THE INVENTION

The invention relates to method for producing a vessel hull for use as a hull of a floating hydrocarbon processing and storage plant (FPSO) or a floating hydrocarbon storage plant (FSO), comprising the steps of:

producing a vessel hull stern portion, a bow portion and a central portion in between the bow and stern portions, with longitudinal hull sides comprising the longitudinal hull sides of the stern portion, the bow portion and the central portion, arranging a deck on the hull, suitable for supporting hydrocarbon processing modules, arranging hydrocarbon storage tanks inside the hull, for storing hydrocarbons to be obtained from a seabed-based wellhead, and providing the hull with an anchoring connection arrangement for connection with anchor lines suitable for mooring the FPSO or the FSO to a seabed.

BACKGROUND OF THE INVENTION

Such a method is known from, for instance, public use. Usually, currently existing FPSO's and FSO's comprise a vessel with a hull that is specifically built for a single application, i.e. for having a single type of anchor line and riser arrangement. Such a hull can be a purpose-built 'new-built' hull or a second-hand hull that has previously been used for example with an oil tanker.

However, constructing an FPSO or FSO based on such a new-built hull or based on a vessel with a second-hand hull requires a relatively long construction period in a shipyard to obtain an FPSO or FSO with the desired functionality and characteristics, depending on the state of the second-hand hull and the amount of work to be done. Converting a second-hand hull into an FPSO or FSO requires massive and time-consuming structural works within the hull to achieve refurbishment and conversion. Refurbishment of the existing arrangements of the second-hand hull is needed to ensure that the 20 to 30 years' service life of the hull as an FPSO or FSO is guaranteed. Conversion of the hull adds arrangements to make the hull ready for use as an FPSO or FSO. The refurbishment and conversion of the hull occurs often in parallel and the whole operation requires often several dry-docking stops, which can be separated in time.

Since demand for FPSO's and FSO's is ever-increasing and pressure for even shorter construction and delivery times is mounting, the time between purchase order and delivery needs to be reduced. Also the time a hull stays in a dry-dock should be reduced, as the time at the above dry dock is relatively expensive and the slot for performing the refurbishment and conversion work or for building a new hull should be booked well in advance.

Attempts have been made by the present applicant to design and construct a generic, new-built hull that will reduce the time required for construction at the dry dock. Such a generic hull was disclosed at the 2003 Offshore Technology Conference in Houston, Tex. (USA), and in particular in the paper proposed for presentation at the above conference, prepared (among others) by the present applicant. At the time, the idea behind such a generic hull was that the generic hull could be constructed based on a standard tanker conversion, having a standard mooring system and provided with standard process modules.

However, approximately ten years have gone by and the generic hull disclosed during the conference and in the aforementioned paper appears to have done very little, unfortunately, to reduce the time between purchase order and delivery.

Therefore, the need to provide a method for producing a vessel hull for use as a hull of a floating hydrocarbon storage and/or processing plant (FSO, FPSO), wherein the time between purchase order and delivery is reduced, still exists.

An object of the present invention is thus to provide a method for producing a vessel hull for use as a hull of a floating hydrocarbon storage and or processing plant (FSO, FPSO), wherein the time between purchase order and delivery is reduced.

SUMMARY OF THE INVENTION

Hereto, according to the invention, a method for producing a vessel hull for use as a hull for a floating hydrocarbon storage and/or processing plant is provided, comprising the steps of:

producing a vessel hull stern portion, a bow portion and a central portion in between the bow and stern portions, the vessel hull provided with longitudinal hull sides comprising the longitudinal hull sides of the stern portion, the bow portion and the central portion, arranging a deck on the hull suitable for supporting hydrocarbon processing modules, arranging hydrocarbon storage tanks inside the hull, for storing hydrocarbons to be obtained from a seabed-based wellhead, providing the hull with an anchoring connection arrangement for connection with anchor lines suitable for mooring the vessel hull to a seabed, characterized by arranging process module reinforcements in the deck, suitable for supporting hydrocarbon process modules, and at least two of the following steps:

providing both longitudinal hull sides with mooring line connection reinforcements near or in the bow portion and stern portion for connecting mooring lines to be used in a spread-moored anchor line arrangement, and arranging in between the mooring line connection reinforcements in longitudinal direction, riser balcony connection reinforcements on one or both longitudinal hull sides suitable for supporting a riser balcony for connecting risers, providing the bow portion with turret reinforcements suitable for receiving an internal turret, providing the bow portion with turret reinforcements suitable for receiving an external turret, wherein the turret is provided with anchor line connection points and riser connection points.

Thus, a sort of 'multi-purpose hull' is provided, based on a 'design one, build several' philosophy, having reinforcements pre-installed in those hull locations where further FSO or FPSO equipment, in particular relating to anchor line connection points (i.e. the mooring system) and riser connection points, is to be installed. The reinforcements are to be integrated in the hull at the dry dock and subsequently the hull having the aforementioned reinforcements is transported to an quay side that can receive an FPSO or FSO for the actual conversion into an FPSO or FSO having the desired mooring and riser system arrangement. The conversion can be carried out using local equipment. In a particular scenario, the dry dock is for example situated in South Korea, whereas the quay side for the top sides integration for the FPSO is located in Brazil. If, for instance, an FPSO having an external turret system is to be constructed at the FPSO quay side, the 'non-used' reinforcements (i.e. the ones specifically arranged for use with a spread-moored arrangement and/or an internal turret arrangement) can remain in place, then serving only as general structural reinforcements for the vessel hull but not for a mooring arrangement.

It is found in practice that the total time needed for conversion to an FSO or FPSO can be reduced with about 6-12 months, compared to the classic method of converting and refurbishing the hull of an existing second-hand oil tanker.

The size and flexibility of the hull design enables the FSO or FPSO to be moored in various configurations, i.e. to be compatible with any type of environment, water depth, riser type or storage requirement, with no rework needed within the hull.

In the context of this patent application, 'reinforcements' are to be understood as structural reinforcements for providing additional structural strength/stiffness at the respective hull location, to allow the hull to deal with the relatively larger forces occurring at that hull location due to the presence of riser systems, mooring systems, process modules, crane support, flare stack, etcetera.

Another aspect of the invention relates to a vessel hull for use as a hull of a floating hydrocarbon storage and/or processing plant, comprising:

a stern portion, a bow portion and a central portion in between the bow and stern portions, the vessel hull provided with longitudinal hull sides comprising the longitudinal hull sides of the stern portion, the bow portion and the central portion, a deck, arranged on the hull, suitable for supporting hydrocarbon processing modules, hydrocarbon storage tanks, arranged inside the hull, for storing hydrocarbons to be obtained from seabed-based wellheads, an anchoring connection arrangement for connection with anchor lines suitable for mooring the vessel hull to a seabed, characterized in that the deck comprises process module reinforcements suitable for supporting hydrocarbon process modules, and at least two of the following elements:

both longitudinal hull sides comprise mooring line connection reinforcements near or in the bow portion and stern portion for connecting mooring lines to be used with a spread-moored anchor line arrangement and one or both longitudinal hull sides comprise riser balcony connection reinforcements arranged in between the mooring line connection reinforcements in longitudinal direction, suitable for supporting a riser balcony for connecting risers, the bow portion comprises a turret reinforcement suitable for receiving an internal turret, the bow portion comprises a turret reinforcement suitable for receiving an external turret, wherein the turret is provided with anchor line connection points and riser connection points.

An embodiment relates to an aforementioned vessel hull, wherein the vessel hull is produced with the aforementioned method.

In an preferred embodiment, the hull is provided with all 3 elements, meaning that the hull is provided with reinforcements for a spread mooring arrangement, reinforcements for an internal turret arrangement and for reinforcements for an external arrangement.

However, the following embodiments of the hull are within the scope of the claimed invention; a hull which is provided with only the reinforcements for a spread-mooring arrangement and an external turret arrangement, a hull which is provided with only reinforcements for a spread mooring arrangement and an internal turret arrangement or a hull that is provided with only reinforcements for both an internal and external turret arrangement.

Another embodiment relates to an aforementioned vessel hull, wherein a transverse bulkhead is arranged between the bow portion and the central portion, the central portion comprising two longitudinal central portion bulkheads extending in longitudinal direction from the stern portion to the transverse bulkhead, being spaced-apart at a transverse distance D1, the bow portion comprising two longitudinal bow portion bulkheads extending in longitudinal direction from the transverse bulkhead to the bow, being spaced-apart at an internal turret position at a transverse distance D2, wherein, when seen in top view, D2 is larger than a maximum outer diameter of an internal turret to be arranged at the internal turret position in between the two longitudinal bow portion bulkheads. Thus, when constructing the above longitudinal bulkheads, the possible arrangement of an internal turret in between the longitudinal bulkheads in the bow portion is already taken into account during construction of the new build hull. At the same time, only minimal deviation from the usual longitudinal bulkhead production processes is needed.

Preferably, D2 is larger than D1, basically giving the longitudinal bulkheads the appearance of a tuning fork, when seen in top view (i.e. when viewing the hull in its usual orientation from above).

More preferably, the two longitudinal central portion bulkheads and the two longitudinal bow portion bulkheads are comprised by two continuous longitudinal bulkheads extending from the stern portion to the bow, that is to say the longitudinal bulkheads are not actually intersected or interrupted by the transverse bulkhead.

Another embodiment concerns an aforementioned vessel hull, wherein the bow portion comprises a vertical plane of symmetry extending in longitudinal direction, wherein, when seen in top view, the longitudinal bow portion bulkheads are each arranged on one side of the vertical plane of symmetry, wherein the longitudinal bow portion bulkheads extend from the transverse bulkhead to the bow in such a way, that a first section of each longitudinal bow portion bulkhead diverges away from the vertical plane of symmetry and a second consecutive section extends substantially parallel to the vertical plane of symmetry forming a reception space for the internal turret at the internal turret location. The (straight) diverging sections make it easier to obtain the aforementioned tuning fork shape to create the reception space for receiving an internal turret. In practice, a relatively minimal amount of time has to be spent to obtain such a longitudinal bulkhead configuration in the bow portion, compared to having just two longitudinal bulkheads running from stern to bow along the length of the vessel.

An embodiment relates to an aforementioned vessel hull, wherein a third consecutive section converges towards the vertical plane of symmetry. Therein, the first, second and third sections of the longitudinal bow portion bulkheads preferably extend at such angles with respect to the vertical plane of symmetry, and have such dimensions that, when seen in top view, the longitudinal bow portion bulkheads each resemble an arc having a centre of curvature coinciding with a centre point of the internal turret receivable in the reception space.

Yet another embodiment relates to an aforementioned vessel hull, comprising one or more removable propulsion units. Each propulsion unit can be connected to or associated with a (power) generator unit that is removable as well.

Thus, the vessel hull can be transported from a first location (in particular the dry dock) to a second location (most notably the FPSO or FSO quay side) by using the propulsion provided by the removable propulsion units. After the selective work is performed at the quayside (integration of the selected mooring system with riser connection points, meaning adding a (upper and lower) riser balcony, integration of an internal or external turret, adding the process modules, adding flare stack, the cranes, etc) the completed FSO or FSO can be transported by its own propulsion system to the offshore production site were risers and mooring lines are connected to the respective riser and mooring lines connection points. After transportation and hook-up of risers and mooring lines, the temporary and removable propulsion units and the associated generators are disconnected from the hull and removed so that they can be used for another FPSO or FSO hull according the invention. Thus, installing permanent propulsion in the vessel hull is not required anymore, which will reduce the initial CAPEX costs of the FPSO or FSO.

In an embodiment the deck comprises reinforcement suitable for supporting a flare stack and reinforcements for supporting one or more pedestrial cranes.

Another aspect of the invention relates to a method for producing a vessel for use as a floating hydrocarbon storage and/or processing plant using an aforementioned vessel hull comprising the steps of:

arranging the hydrocarbon process modules on the deck, at the location of the process module reinforcements, selecting a desired riser and anchor line arrangement, such as a spread moored arrangement, an internal turret arrangement or an external turret arrangement, and configuring the vessel hull for use with the desired anchor line and riser arrangement, in particular by configuring anchor line connection points and riser connection points.

The above method can be carried out conveniently at the second location, away from the dry dock, to obtain the finalized or close-to-being-finalized FPSO or FSO.

The above method may further comprise the steps of:

transferring the vessel for use as a floating storage and processing plant to a location near the seabed-based wellhead, connecting the anchor lines to the anchor line connection points and the risers to the riser connection points.

In a preferred embodiment of the above method, the aforementioned vessel hull is thus produced at a first location, and the method for producing the vessel for use as a floating hydrocarbon storage and/or processing plant (FPSO, FSO) using the vessel hull is carried out at a second location, being different from the first location, comprising transporting the hull from the first location to the second location.

Preferably, prior to transporting the hull from the first location to the second location, the removable propulsion units are integrated in and connected to the vessel hull, wherein the vessel hull is transported from the first to the second location by using the propulsion provided by the removable propulsion units, wherein after transportation the removable propulsion units are disconnected from the hull. As stated before, the first location comprises a dry dock and the second location is a quay side suitable for receiving the vessel hull, in particular an FSO or FPSO quay side, such that only a relatively small part of the total FSO or FPSO construction and process integration time has to be spent at the dry dock.

Patent publications US 2011/263169 A1, US 2003/205188 A1, U.S. Pat. No. 6,126,501 A, US 2009/126617 A1, U.S. Pat. No. 6,453,838 A1 and US 2009/078185 A1 describe further technical background.

BRIEF DESCRIPTION OF THE DRAWINGS

Embodiments of a vessel hull according to the invention will by way of non-limiting example be described in detail with reference to the accompanying drawings. In the drawings.

DETAILED DESCRIPTION OF THE INVENTION

Figure 1:
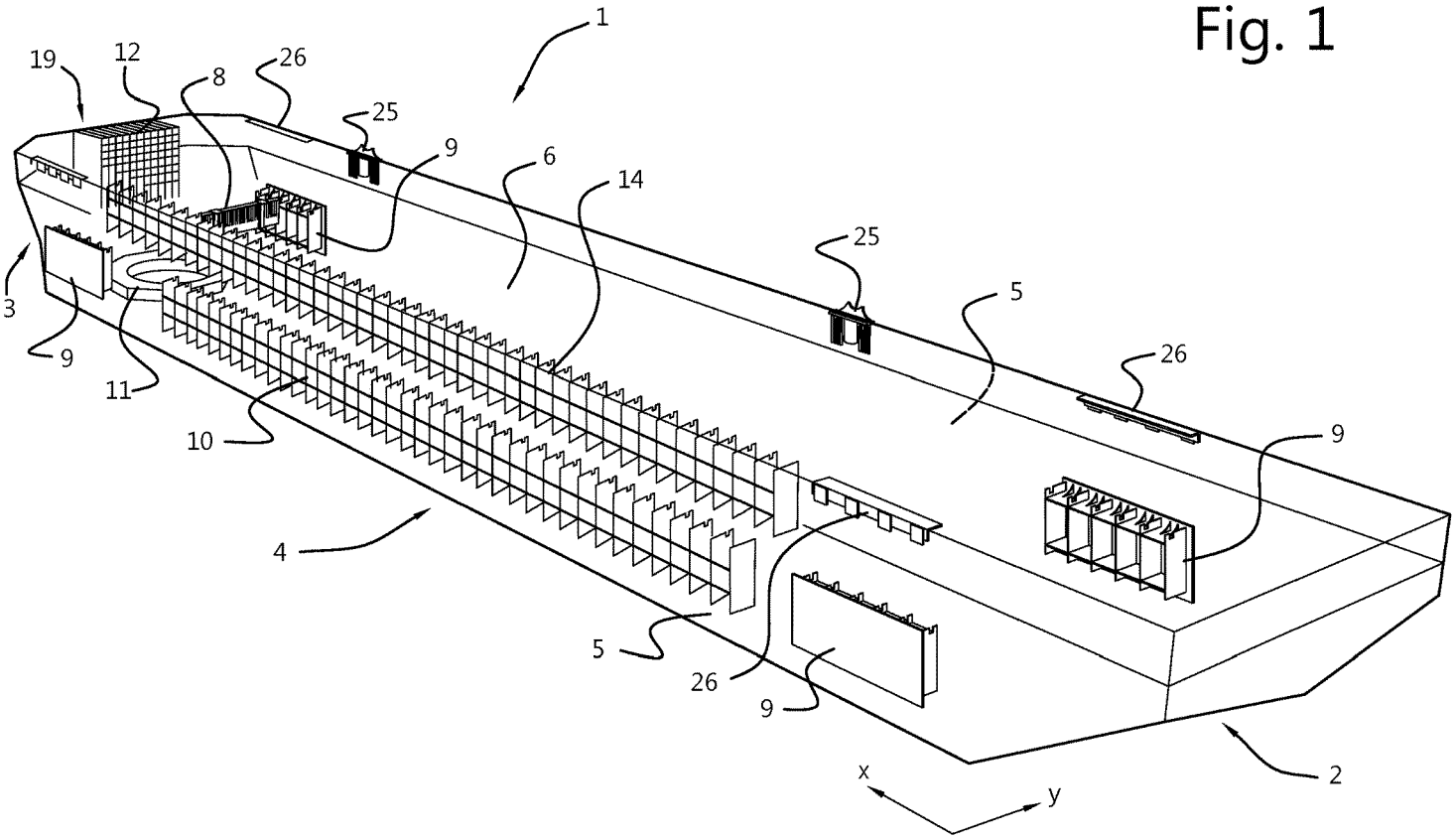
FIG. 1 shows a perspective view of an embodiment of a vessel hull having pre-installed reinforcements.
Figure 2:
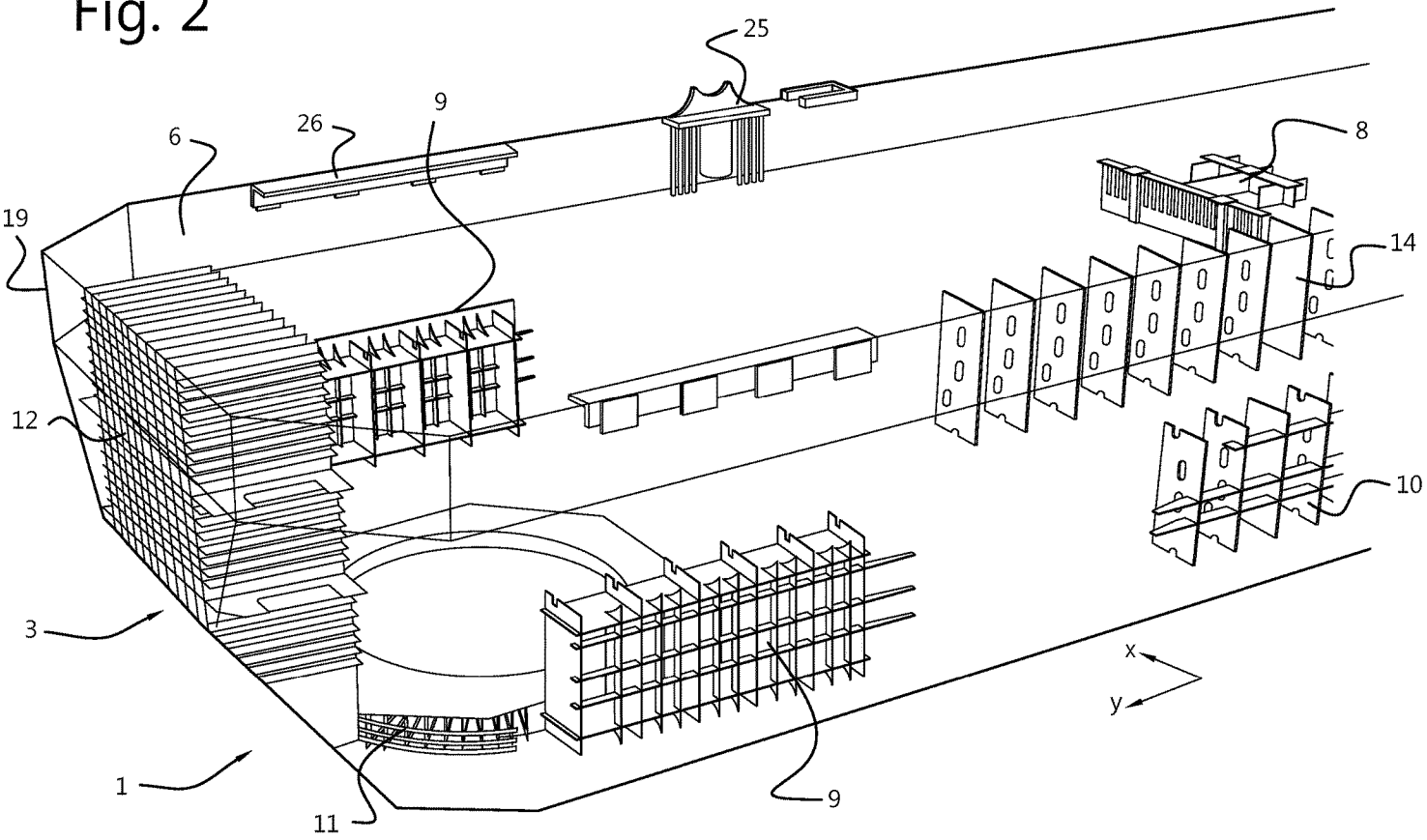
FIG. 2 shows a close-up view of the bow portion of the vessel hull as shown in FIG. 1.

FIGS. 1-5 will be discussed in conjunction. FIG. 1 shows a perspective view of a hull 1 of a floating hydrocarbon processing and storage plant (FPSO) having reinforcements pre-installed according to the invention. The hull 1 has a stern portion 2 (shown in the lower right part of FIG. 1), a bow portion 3 (shown in the upper left part of FIG. 1) and a central portion 4 in between the bow 3 and stern portions 2, with longitudinal hull sides 5 comprising the longitudinal hull sides of the stern portion 2, the bow portion 3 and the central portion 4. A deck 6 is arranged on the hull 1 for supporting n processing modules (not shown) like hydrocarbon process modules used for FPSO's or metering skids used for FSO's. Also, hydrocarbon storage tanks (not shown) are to arranged inside the hull 1, for storing hydrocarbons to be obtained directly from seabed-based wellheads (FPSO) or indirectly via another hydrocarbon production vessel (not shown) in case of an FSO. An anchoring connection arrangement 7 (see FIGS. 3 and 5) is to be provided during use for connection with anchor lines suitable for mooring the FPSO or FSO to a seabed. The orientation of the vessel hull 1 as shown in FIGS. 1-5 corresponds with the usual orientation of such a vessel hull 1 during use. The width of the vessel hull 1 (in Y-direction) may for instance amount to 60 m. The vessel length in longitudinal X direction may typically amount to for instance 350 m.

According to the invention, the deck 6 comprises process module reinforcements 8 for supporting the hydrocarbon process and other modules during use. An example of such a process module reinforcement 8 is shown near the bow portion 3 of the hull 1. Apart from supporting process modules, similar reinforcements can be provided to the deck 6, in particular reinforcements for a flare, cranes (such as the crane pedestal 25 shown in FIGS. 2 and 5) or vent masts.

Both longitudinal hull sides 5 can comprise mooring line connection reinforcements 9 near or in the bow portion 3 for connecting mooring lines to be used with a spread-moored anchor line arrangement 13. Two of such mooring line connection reinforcements 9 are arranged at both sides of the vessel hull 1 near or in the bow portion 3. Similarly, two of such mooring line connection reinforcements 9 are arranged in a similar fashion at the stern portion 2 of the vessel hull 1. At deck 6 level, above the mooring line reinforcements 9, chain tensioning system reinforcements 26 (see FIG. 2) are preferably provided to provide support for chain tensioning systems 27 to be used for tensioning the chains in case of a spread-moored anchor line arrangement 13.

Furthermore, one or more longitudinal hull sides 5 can comprise lower riser connection reinforcements 10 and upper riser connection reinforcements 14 arranged in between the mooring line connection reinforcements 9 in longitudinal direction X. The riser connection reinforcements 10, 14 are for supporting lower and upper riser balconies 28, 29 (see FIGS. 4 and 5) for connecting risers 31 (see FIG. 4). The riser connection reinforcements 10, 14 preferably have a length in longitudinal direction X roughly corresponding to the length of the respective riser balconies 28, 29.

Figure 3:
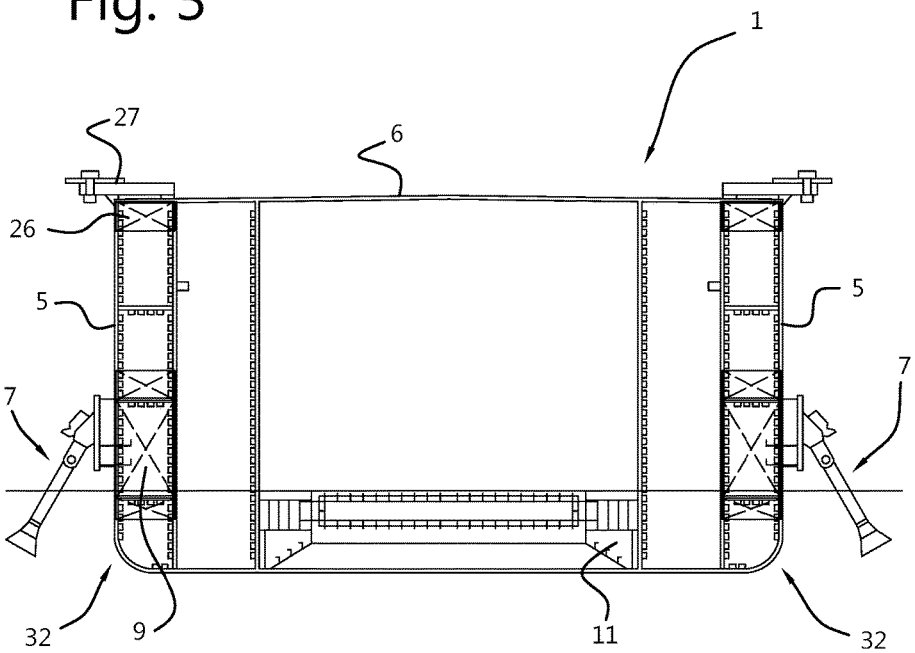
FIG. 3 shows a cross-section of an embodiment of a vessel hull according to the invention, at a typical longitudinal vessel hull position where the anchor line arrangements to be used with a spread-moored arrangement are to be found.
Figure 4:
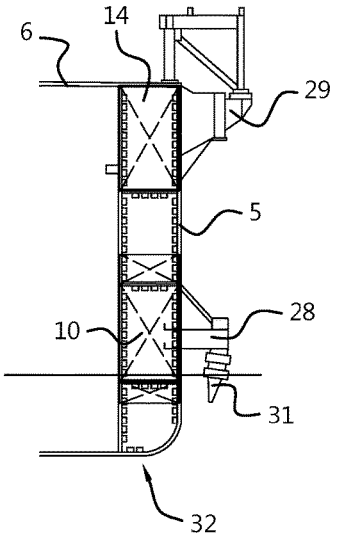
FIG. 4 shows a partial cross-section of the embodiment according to FIG. 3, at a typical longitudinal vessel hull position where the riser balconies are to be found.
Figure 5:
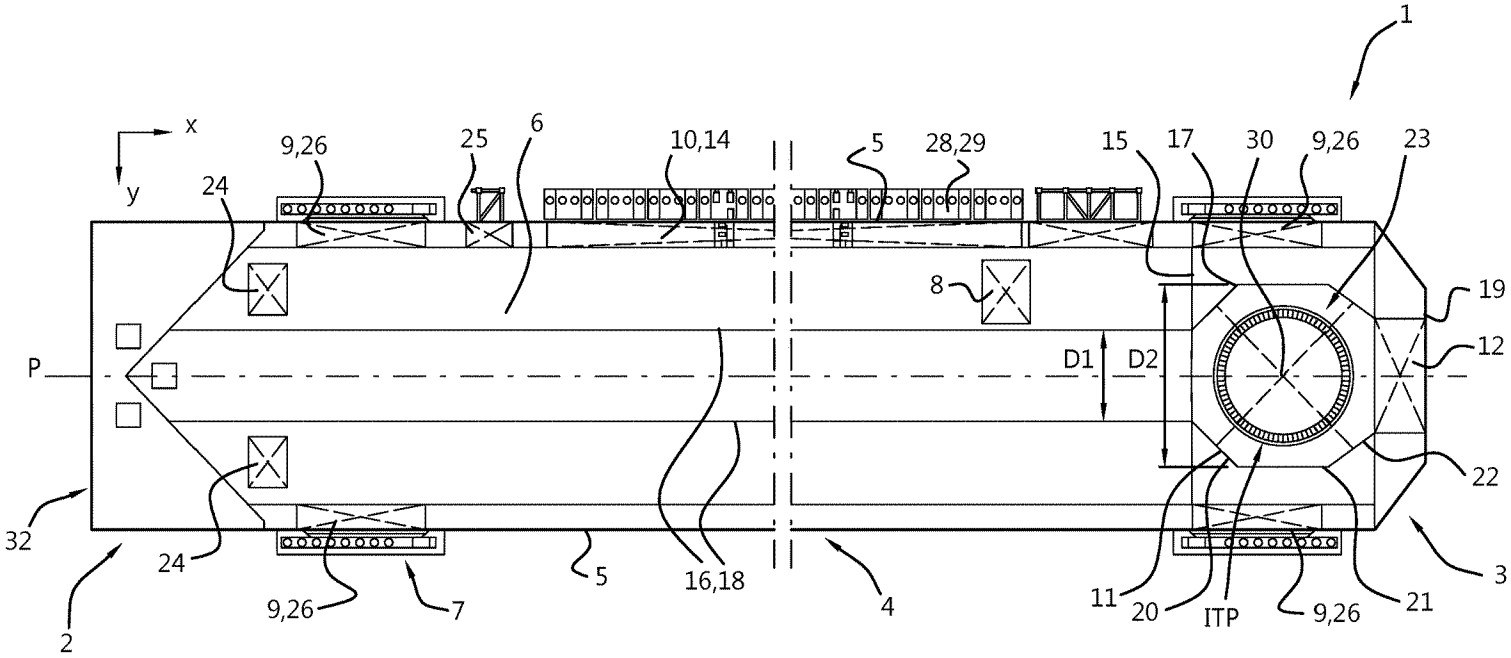
FIG. 5 shows a top view of the embodiment of the vessel hull according to FIGS. 3 and 4.

Preferably, the vessel hull 1 comprises ballast tanks 32 at both longitudinal sides 5 of the vessel (as shown in FIGS. 3, 4 and 5). More preferably, the ballast tanks 32 comprise the mooring line connection reinforcements 9, the lower riser connection reinforcements 10, the upper riser connection reinforcements 14 and/or the chain tensioning system reinforcements 26, i.e. these reinforcements 9, 10, 14, 26 are then arranged in the hollow space of the ballast tanks 32. The reinforcements 9, 10, 14, 26 may comprise reinforcement plates that extend in a plane perpendicular to the longitudinal direction X, for instance over the whole of the cross-section of the hollow space of the ballast tanks 32. The skilled person will understand that the anchoring connection arrangements 7, the chain tensioning systems 27 and the lower an upper riser balconies 28, 29 are also to be connected or arranged on the respective ballast tanks 32.

According to the invention the bow portion 3 can comprises both internal turret reinforcements 11 and external turret reinforcements 12 for receiving both an internal or an external turret (not shown). The turrets are then provided with anchor line connection points and riser connection points. As mentioned before the hull according the invention can have reinforcements for all 3 types of mooring arrangements (reinforcements for spread mooring, an internal turret and an external turret mooring arrangement) or just for 2 of the 3 mooring arrangements, like reinforcements for a spread mooring arrangement combined with reinforcements for an internal turret mooring arrangement, or reinforcements for a spread mooring arrangement combined with reinforcement for an external turret mooring arrangement or reinforcements for an internal turret mooring arrangement combined with reinforcements for an external turret mooring arrangement.

As shown in the right part of FIG. 5, a transverse (i.e. extending in Y-direction) bulkhead 15 is arranged between the bow portion 3 and the central portion 4. The central portion 4 comprises two longitudinal central portion bulkheads 16 extending in longitudinal direction X from the stern portion 2 to the transverse bulkhead 15, being spaced-apart at a transverse distance D1. The bow portion 3 comprises two longitudinal bow portion bulkheads 17 extending in longitudinal direction X from the transverse bulkhead 15 to the bow 19, being spaced-apart at an internal turret position ITP at a transverse distance D2, wherein, when seen in top view, D2 is larger than a maximum outer diameter of an internal turret to be arranged at the internal turret position ITP in between the two longitudinal bow portion bulkheads 17. D2 preferably is larger than D1, such as 1.5-2.5 times D1, for instance about 2 times D1.

The two longitudinal central portion bulkheads 16 and the two longitudinal bow portion bulkheads are comprised by two continuous longitudinal bulkheads 18 extending from the stern portion to the bow 19, i.e. these longitudinal bulkheads 18 are each formed as single, integral elements.

The vessel hull 1 and in particular the bow portion 3 comprises a vertical plane of symmetry P extending in longitudinal direction X. When seen in top view, the longitudinal bow portion bulkheads 17 are each arranged on one side of the vertical plane of symmetry P. The longitudinal bow portion bulkheads 17 extend from the transverse bulkhead 15 to the bow 19 in such a way, that a first section 20 of each longitudinal bow portion bulkhead diverges away from the vertical plane of symmetry P. A second consecutive section 21 extends substantially parallel to the vertical plane of symmetry P. Thus, a reception space 23 for the internal turret is formed at the internal turret location ITP. Preferably, a third consecutive section 22 converges towards the vertical plane of symmetry P. The first 20, second 21 and third 22 sections of the longitudinal bow portion bulkheads 17 extend at such angles with respect to the vertical plane of symmetry P, and have such dimensions that, when seen in top view, the longitudinal bow portion bulkheads 17 each roughly resemble an arc having a centre of curvature coinciding with a centre point 30 of the internal turret receivable in the reception space 23. When seen in top view, the angles as mentioned above may for instance relate to enclosed angles with respect to the vertical plane of symmetry P of 30-60°, preferably about 45°.

In a particular configuration, the vessel hull 1 comprises one or more removable propulsion units 24, for instance azimuth thrusters or the like, to facilitate transport from the dry dock to the FPSO/FSO quay side and/or from the FPSO/FSO quay side to the offshore production side where the FPSO or FSO will be installed and connected to the mooring lines. Removable diesel-electric or gas-powered propulsion units are also conceivable as well as removable power generators that are associated with the removable propulsion units.

Thus, the invention has been described by reference to the embodiments discussed above. It will be recognized that the embodiments are susceptible to various modifications and alternative forms well known to those of skill in the art without departing from the spirit and scope of the invention. Accordingly, although specific embodiments have been described, these are examples only and are not limiting upon the scope of the invention.

REFERENCE NUMERALS

1. Vessel hull
2. Vessel hull stern portion
3. Vessel hull bow portion
4. Vessel hull central portion
5. Longitudinal hull sides
6. Deck
7. Anchoring connection arrangement
8. Process module reinforcements
9. Mooring line connection reinforcements
10. Lower riser connection reinforcements
11. Internal turret reinforcements

12. External turret reinforcements
13. Spread-moored anchor line arrangement
14. Upper riser connection reinforcements
15. Transverse bulkhead
16. Longitudinal central portion bulkheads
17. Longitudinal bow portion bulkheads
18. Continuous longitudinal bulkheads
19. Bow
20. First section
21. Second section
22. Third section
23. Reception space
24. Removable propulsion unit
25. Crane pedestal
26. Chain tensioning system reinforcements
27. Chain tensioning system
28. Lower riser balcony
29. Upper riser balcony
30. Internal turret centre point
31. Riser
32. Ballast tank
X=longitudinal direction
Y=transverse direction
ITP=internal turret position
P=vertical plane of symmetry

The invention claimed is:

1. A method for producing a vessel hull for use as a hull for a floating hydrocarbon storage and/or processing plant, comprising the steps of:

producing a vessel hull stern portion, a bow portion and a central portion in between the bow and stern portions, the vessel hull being provided with longitudinal hull sides comprising the longitudinal hull sides of the stem portion, the bow portion and the central portion, arranging a deck on the hull suitable for supporting hydrocarbon processing modules, arranging hydrocarbon storage tanks inside the hull, for storing hydrocarbons to be obtained from a seabed-based wellhead, providing the hull with an anchoring connection arrangement for connection with anchor lines suitable for mooring the vessel hull to a seabed, arranging process module reinforcements in the deck, suitable for supporting hydrocarbon process modules, and at least two of the following steps:

providing both longitudinal hull sides with mooring line connection reinforcements near or in the bow portion and stern portion for connecting mooring lines to be used in a spread-moored anchor line arrangement, and arranging in between the mooring line connection reinforcements in longitudinal direction, riser balcony connection reinforcements in one or both longitudinal hull sides suitable for supporting a riser balcony for connecting risers, providing the bow portion with turret reinforcements suitable for receiving an internal turret, providing the bow portion with turret reinforcements suitable for receiving an external turret, wherein the turret is provided with anchor line connection points and riser connection points.

2. A vessel hull for use as a hull for a floating hydrocarbon storage and/or processing plant, comprising:

a stern portion, a bow portion and a central portion in between the bow and stern portions, the vessel hull provided with longitudinal hull sides comprising the longitudinal hull sides of the stern portion, the bow portion and the central portion, a deck, arranged on the hull, suitable for supporting hydrocarbon processing modules, hydrocarbon storage tanks, arranged inside the hull, for storing hydrocarbons to be obtained from seabed-based wellheads, an anchoring connection arrangement for connection with anchor lines suitable for mooring the vessel hull to a seabed, wherein the deck comprises process module reinforcements suitable for supporting hydrocarbon process modules, and at least two of the following elements:

both longitudinal hull sides comprise mooring line connection reinforcements near or in the bow portion and stern portion for connecting mooring lines to be used with a spread-moored anchor line arrangement and one or both longitudinal hull sides comprise riser balcony connection reinforcements arranged in between the mooring line connection reinforcements in longitudinal direction, suitable for supporting a riser balcony for connecting risers, the bow portion comprises a turret reinforcement suitable for receiving an internal turret, the bow portion comprises a turret reinforcement suitable for receiving an external turret, wherein the turret is provided with anchor line connection points and riser connection points.

3. The vessel hull according to claim 2, wherein a transverse bulkhead is arranged between the bow portion and the central portion, the central portion comprising two longitudinal central portion bulkheads extending in longitudinal direction (X) from the stern portion to the transverse bulkhead, being spaced-apart at a transverse distance D1, the bow portion comprising two longitudinal bow portion bulkheads extending in longitudinal direction from the transverse bulkhead to the bow, being spaced-apart at an internal turret position at a transverse distance D2, wherein, when seen in top view, D2 is larger than D1.

4. The vessel hull according to claim 3, wherein D2 is equal to or larger than the transverse diameter of the turret reinforcements.

5. The vessel hull according to claim 3, wherein the two longitudinal central portion bulkheads and the two longitudinal bow portion bulkheads are comprised by two continuous longitudinal bulkheads extending from the stern portion to the bow.

6. The vessel hull according to claim 3, wherein the bow portion comprises a vertical plane of symmetry (P) extending in longitudinal direction, wherein, when seen in top view, the longitudinal bow portion bulkheads are each arranged on one side of the vertical plane of symmetry, wherein the longitudinal bow portion bulkheads extend from the transverse bulkhead to the bow in such a way, that a first section of each longitudinal bow portion bulkhead diverges away from the vertical plane of symmetry and a second consecutive section extends substantially parallel to the vertical plane of symmetry forming a reception space for the internal turret at the internal turret location (ITP).

7. The vessel hull according to claim 6, wherein a third consecutive section converges towards the vertical plane of symmetry.

8. The vessel hull according to claim 7, wherein the first, second and third sections of the longitudinal bow portion bulkheads extend at such angles with respect to the vertical plane of symmetry, and have such dimensions that, when seen in top view, the longitudinal bow portion bulkheads each resemble an arc having a centre of curvature coinciding with a centre point of the internal turret receivable in the reception space.

9. The vessel hull according to claim 2, comprising one or more removable propulsion units.

10. The vessel hull according claim 9, comprising one or more removable generator units associated with the one or more removable propulsion units.

11. The vessel hull according to claim 2, wherein the deck comprises reinforcement suitable for supporting a flare stack and reinforcements for supporting one or more pedestrial cranes.

12. A method for producing a vessel for use as a floating hydrocarbon storage and/or processing plant using a vessel hull comprising a stern portion, a bow portion and a central portion in between the bow and stern portions, and provided with longitudinal hull sides of the stern portion, the bow portion and the central portion; a deck arranged on the hull, the deck comprising process module reinforcements suitable for supporting hydrocarbon process modules; hydrocarbon storage tanks arranged inside the hull; an anchoring connection arrangement for connection with anchor lines suitable for mooring the vessel hull to a seabed; and further comprising at least two of the following:

both longitudinal hull sides comprise mooring line connection reinforcements near or in the bow portion and stern portion for connecting mooring lines to be used with a spread-moored anchor line arrangement and one or both longitudinal hull sides comprise riser balcony connection reinforcements arranged in between the mooring line connection reinforcements in longitudinal direction, suitable for supporting a riser balcony for connecting risers, the bow portion comprises a turret reinforcement suitable for receiving an internal turret, the bow portion comprises a turret reinforcement suitable for receiving an external turret, wherein the turret is provided with anchor line connection points and riser connection points, the method comprising the steps of:

arranging the hydrocarbon process modules on the deck, at the location of the process module reinforcements, selecting a desired riser and anchor line arrangement, and configuring the vessel hull for use with the desired anchor line and riser arrangement.

13. The method according to claim 12, further comprising the steps of:

transferring the vessel for use as a floating hydrocarbon storage and/or processing plant to a location near the seabed-based wellhead, and connecting the anchor lines to the anchor line connection points and the risers to the riser connection points.

14. The method according to claim 12, wherein the vessel hull is produced at a first location, and the method for producing the vessel for use as a floating hydrocarbon storage and/or processing plant using the vessel hull is carried out at a second location different from the first location, the method comprising transporting the vessel hull from the first location to the second location.

15. The method according to claim 14, wherein one or more removable propulsion units are connected to the vessel hull prior to transporting the hull from the first location to the second location, and the vessel hull is transported from the first to the second location by using the propulsion provided by the one or more removable propulsion units.

16. The method according to claim 15, wherein one or more removable generator units are disconnected and removed from the hull after transportation from the first location to the second location.

17. The method according to claim 14, wherein the step of transporting the hull from the first location to the second location comprises transporting the hull from a dry dock to a quay side suitable for receiving the vessel hull.

18. The method according to claim 15, and further comprising disconnecting and removing the one or more removable propulsion units from the hull after transportation from the first location to the second location.

19. The method according to claim 14, wherein the step of configuring the vessel hull for use with the desired anchor line and riser arrangement comprises configuring anchor line connection points and riser connection points.

* * * * *